US007448100B1

(12) United States Patent
Shih

(10) Patent No.: US 7,448,100 B1
(45) Date of Patent: Nov. 11, 2008

(54) MOTORIZED BED THAT IS MOVABLY CLOSER TO THE WALL

(75) Inventor: Lung-Tan Shih, Lukang Town (TW)

(73) Assignee: Ruoey Lung Enterprise Corp., Changhua Hsien (TW)

( * ) Notice: Subject to any disclaimer, the term of this patent is extended or adjusted under 35 U.S.C. 154(b) by 240 days.

(21) Appl. No.: 11/472,208

(22) Filed: Jun. 21, 2006

(51) Int. Cl.
*A61G 7/80* (2006.01)

(52) U.S. Cl. ..... 5/600; 5/617; 5/619

(58) Field of Classification Search ..... 5/607–613, 5/617–619, 108–109, 600
See application file for complete search history.

(56) References Cited

U.S. PATENT DOCUMENTS 6,851,144 B2 * 2/2005 Wang ..... 5/610

* cited by examiner

*Primary Examiner*—Frederick Coney
(74) *Attorney, Agent, or Firm*—Alan Kamrath; Kamrath & Associates PA

(57) ABSTRACT

A motorized bed includes a base frame, a linking frame movably mounted on the base frame, a first support frame pivotally mounted on the linking frame, two first links each pivotally mounted between the base frame and the first support frame, a second support frame pivotally mounted on the linking frame, a lift frame pivotally mounted on the second support frame, two second links each pivotally mounted between the linking frame and the lift frame, and a cushion mounted on the linking frame. Thus, when the motorized bed is folded, the front portion of the cushion is movable forward to get closer to the cabinet, so that a user can use the cabinet easily and conveniently, thereby facilitating the user taking items placed on the cabinet.

18 Claims, 8 Drawing Sheets

MOTORIZED BED THAT IS MOVABLY CLOSER TO THE WALL

BACKGROUND OF THE INVENTION

1. Field of the Invention

The present invention relates to a motorized bed and, more particularly, to a motorized bed available for a patient.

2. Description of the Related Art

A conventional medical bed comprises a main frame, a cushion mounted on the main frame, and a rocker handle mounted on the tail portion of the main frame to drive a gear mechanism to fold the bed so as to lift or lower the front portion of the cushion. Thus, the rocker handle is operated to drive the gear mechanism to lift the front portion of the cushion to facilitate the patient on the cushion taking the medicine, eating the food or reading the book. However, when the bed is folded, the front portion of the cushion is movable backward away from the wall and the cabinet, so that a user cannot use the cabinet easily and conveniently, thereby causing inconvenience to the user when taking items placed on the cabinet. In addition, the bed is folded and expanded by rotation of the rocker handle, so that the bed is operated manually, thereby wasting the manual energy.

BRIEF SUMMARY OF THE INVENTION

In accordance with the present invention, there is provided a motorized bed, comprising a base frame, a linking frame movably mounted on the base frame, a first support frame pivotally mounted on the linking frame, two first links each pivotally mounted between the base frame and the first support frame, a second support frame pivotally mounted on the linking frame, a lift frame pivotally mounted on the second support frame, two second links each pivotally mounted between the linking frame and the lift frame, and a cushion mounted on the linking frame and having a first portion mounted on the first support frame to move therewith and a second portion mounted on the second support frame and the lift frame to move therewith.

The primary objective of the present invention is to provide a motorized bed that is movably closer to the wall.

Another objective of the present invention is to provide a motorized bed, wherein when the motorized bed is folded, the front portion of the cushion is movable forward to get closer to the cabinet, so that a user can use the cabinet easily and conveniently, thereby facilitating the user taking items placed on the cabinet in an energy-saving manner.

A further objective of the present invention is to provide a motorized bed, wherein when the motorized bed is folded, the rear portion of the cushion is lifted by the lift frame and supported by the second support frame and the second links, so that the user's legs are lifted and supported by the cushion at a determined height, thereby providing a comfortable sensation to the user.

A further objective of the present invention is to provide a motorized bed, wherein the motorized bed is operated automatically by the two drive cylinders, so that the user can operate the motorized bed easily and quickly in an energy-saving manner.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
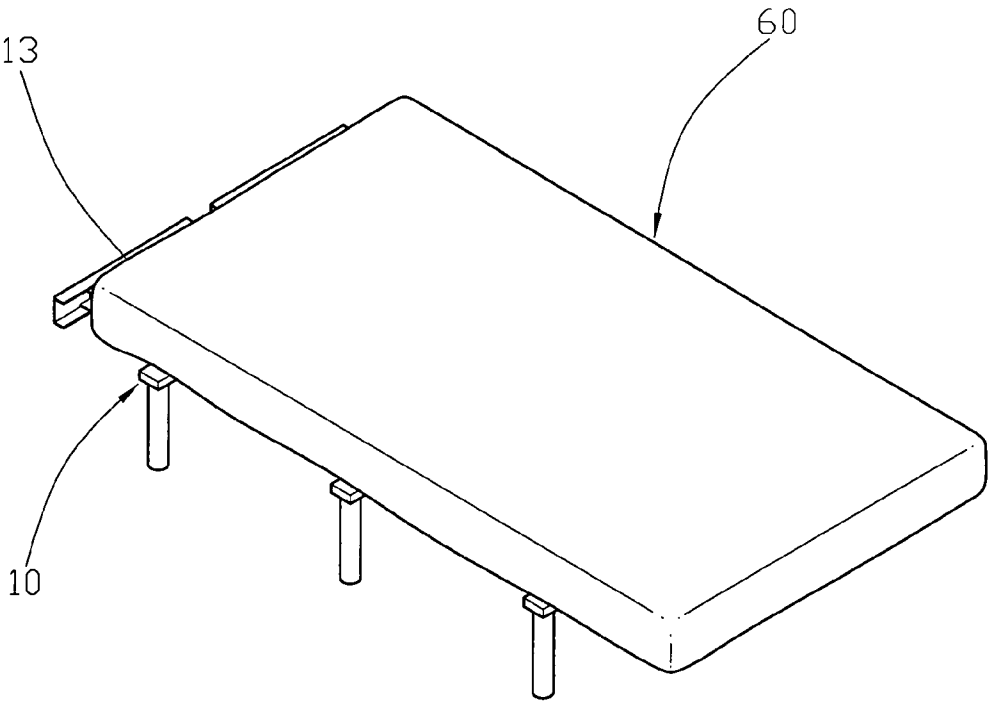
FIG. 1 is a perspective view of a motorized bed in accordance with the preferred embodiment of the present invention.
Figure 2:
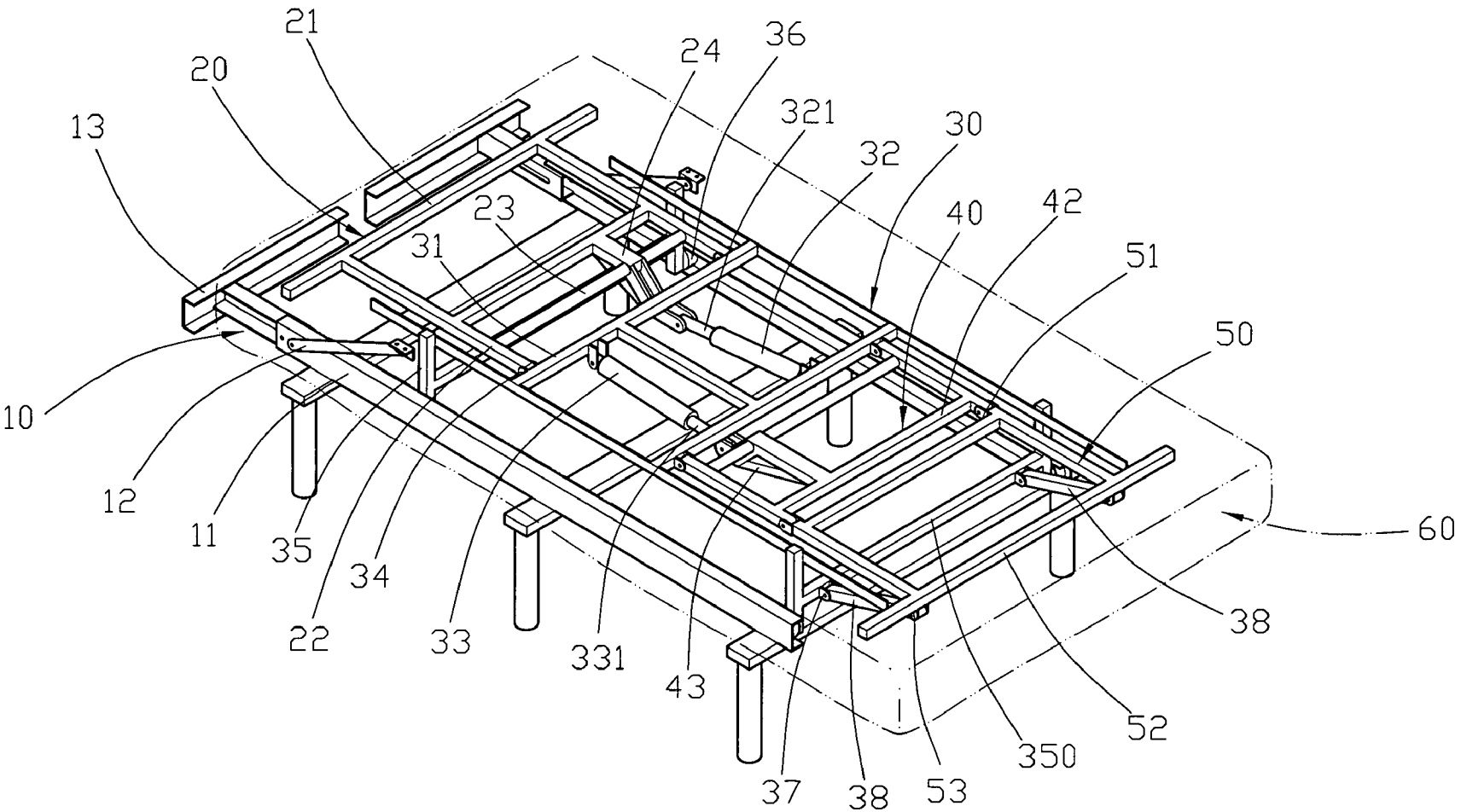
FIG. 2 is a broken perspective view of the motorized bed as shown in FIG. 1.
Figure 3:
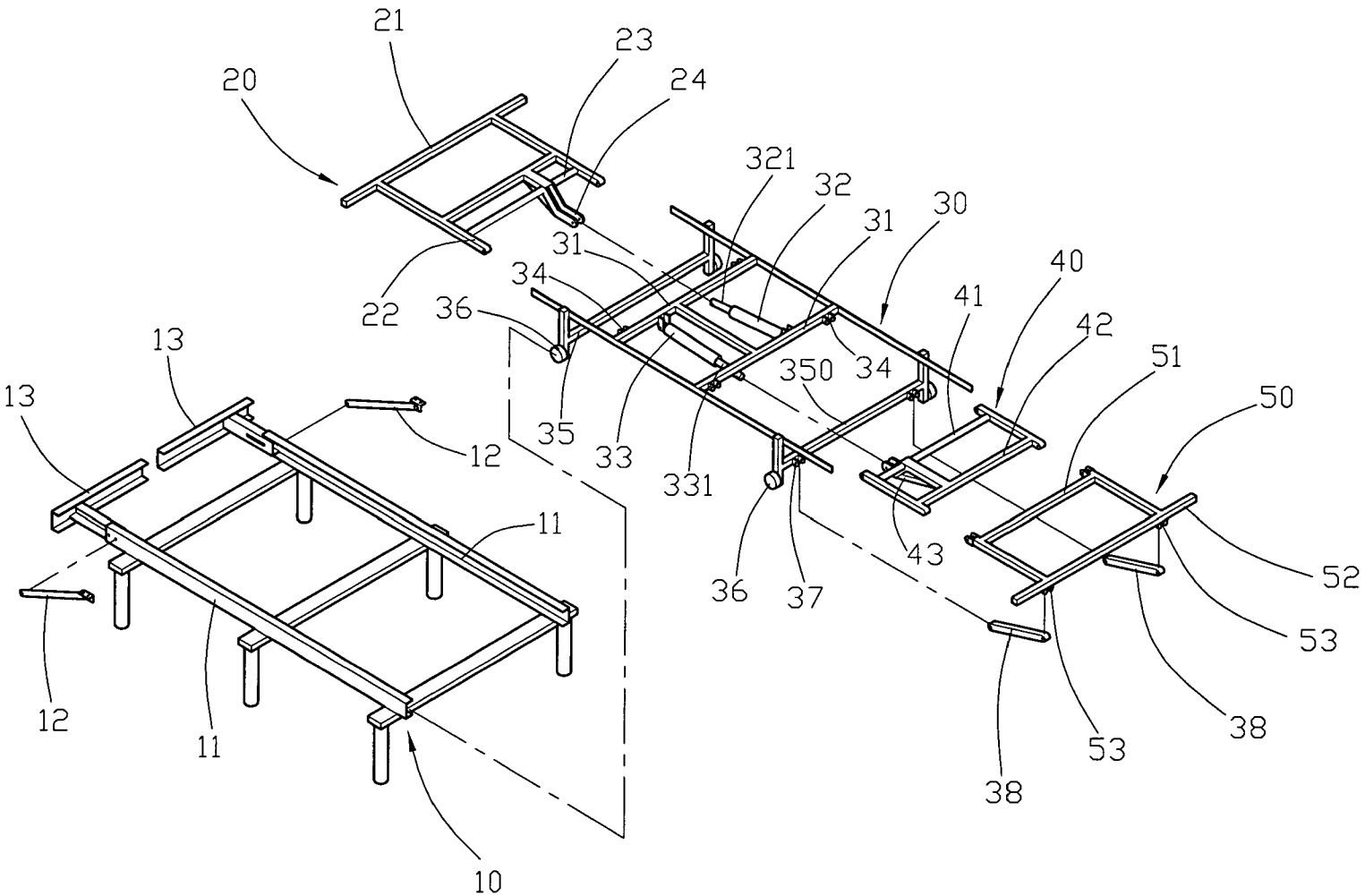
FIG. 3 is an exploded perspective view of the motorized bed as shown in FIG. 2.
Figure 4:
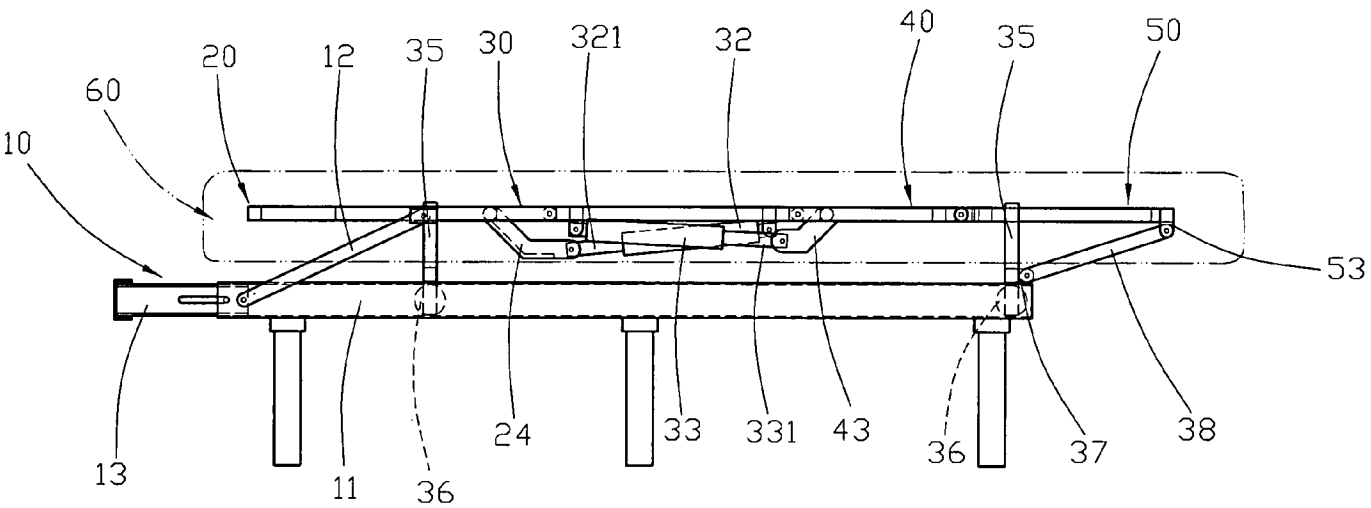
FIG. 4 is a plan view of the motorized bed as shown in FIG. 2.

Referring to the drawings and initially to FIGS. 1-4, a motorized bed in accordance with the preferred embodiment of the present invention comprises a base frame 10, a linking frame 30 movably mounted on the base frame 10, a first support frame 20 pivotally mounted on the linking frame 30, two first links 12 each pivotally mounted between the base frame 10 and the first support frame 20, a second support frame 40 pivotally mounted on the linking frame 30, a lift frame 50 pivotally mounted on the second support frame 40, two second links 38 each pivotally mounted between the linking frame 30 and the lift frame 50, a cushion 60 mounted on the linking frame 30 and having a first portion mounted on the first support frame 20 to move therewith and a second portion mounted on the second support frame 40 and the lift frame 50 to move therewith.

The base frame 10 is provided with two opposite guide tracks 11, and two extension brackets 13 each adjustably mounted on the respective guide track 11.

The linking frame 30 has a first portion provided with a first slide 35 movably mounted on the base frame 10 and a second portion provided with a second slide 350 movably mounted on the base frame 10. Each of the first slide 35 and the second slide 350 of the linking frame 30 is substantially H-shaped and provided with two rollers 36 rotatably mounted in the guide tracks 11 of the base frame 10 respectively so that the linking frame 30 is movable between the guide tracks 11 of the base frame 10. The second slide 350 of the linking frame 30 is provided with two pivot bases 37. The linking frame 30 has a mediate portion provided with a support bracket 31. The support bracket 31 of the linking frame 30 is provided with a plurality of pivot seats 34.

The first support frame 20 has a first portion 22 pivotally mounted on the support bracket 31 of the linking frame 30 by the respective pivot seats 34 of the linking frame 30 and a second portion provided with a resting bar 21 rested on the cushion 60. The first support frame 20 has a mediate portion provided with a transverse rod 23 and a substantially V-shaped pivot arm 24 having a first portion secured to the transverse rod 23.

A drive cylinder 32 is mounted between the linking frame 30 and the first support frame 20 and has a first portion pivotally mounted on the support bracket 31 of the linking frame 30 and a second portion provided with a retractable rod 321 pivotally mounted on a second portion of the pivot arm 24 of the first support frame 20.

The second support frame 40 has a first portion 41 pivotally mounted on the support bracket 31 of the linking frame 30 by the respective pivot seats 34 of the linking frame 30 and a second portion 42 provided with a substantially V-shaped pivot arm 43.

A drive cylinder 33 is mounted between the linking frame 30 and the second support frame 40 and has a first portion pivotally mounted on the support bracket 31 of the linking frame 30 and a second portion provided with a retractable rod 331 pivotally mounted on the pivot arm 43 of the second support frame 40.

The lift frame 50 has a first portion 51 pivotally mounted on the second portion 42 of the second support frame 40 and a second portion provided with a resting bar 52 rested on the cushion 60. The resting bar 52 of the lift frame 50 is provided with two pivot bases 53.

Each of the two first links 12 has a first portion pivotally mounted on the base frame 10 and a second portion pivotally mounted on the first portion of the cushion 60.

Each of the two second links 38 has a first portion pivotally mounted on the second slide 350 of the linking frame 30 by the respective pivot base 37 of the linking frame 30 and a second portion pivotally mounted on the resting bar 52 of the lift frame 50 by the respective pivot base 53 of the lift frame 50.

Figure 5:
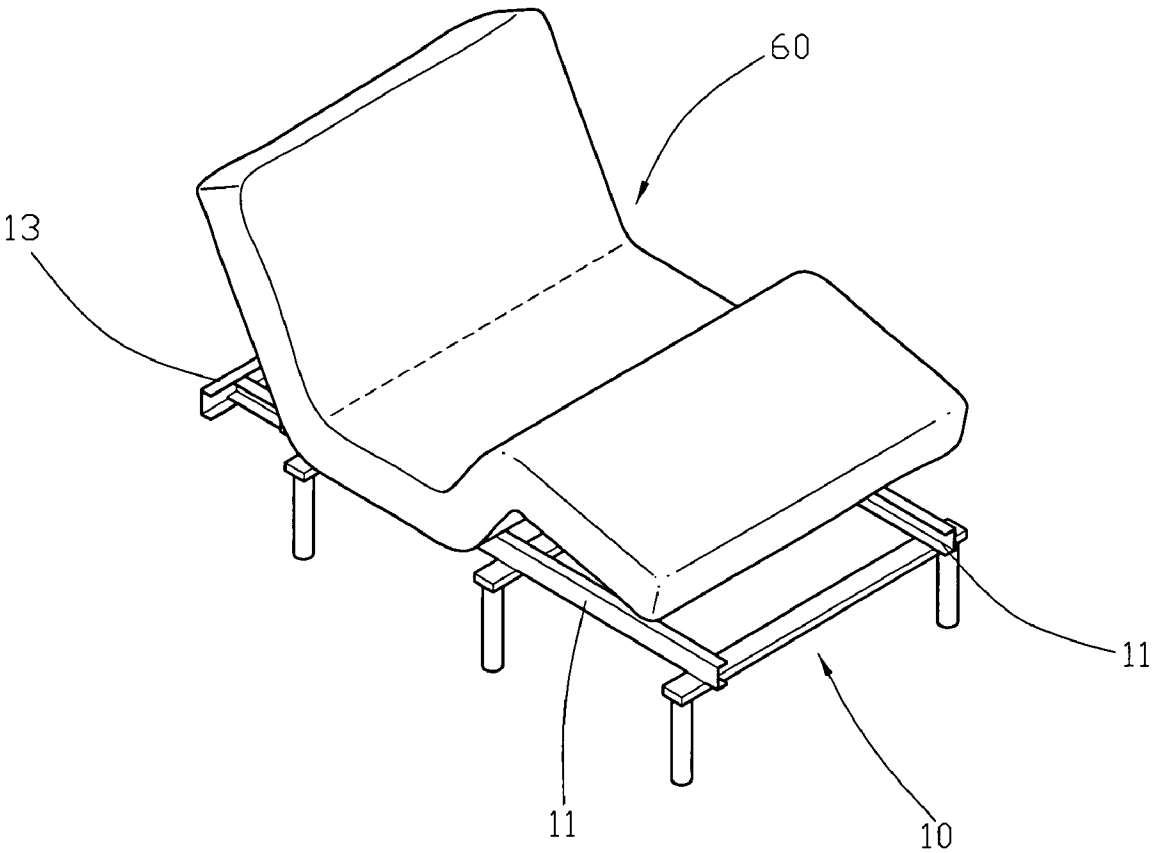
FIG. 5 is a schematic operational view of the motorized bed as shown in FIG. 1.
Figure 6:
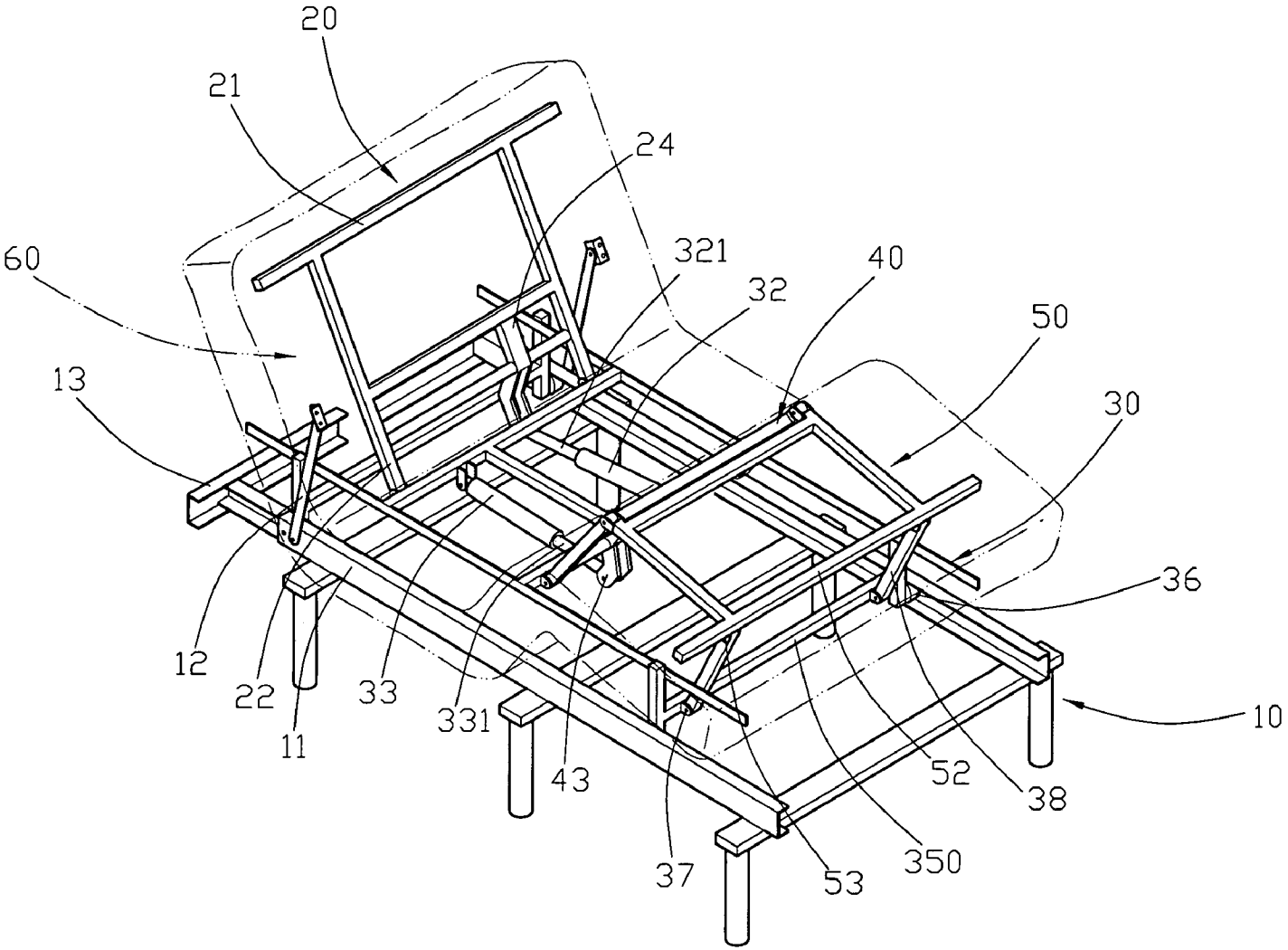
FIG. 6 is a schematic operational view of the motorized bed as shown in FIG. 2.
Figure 7:
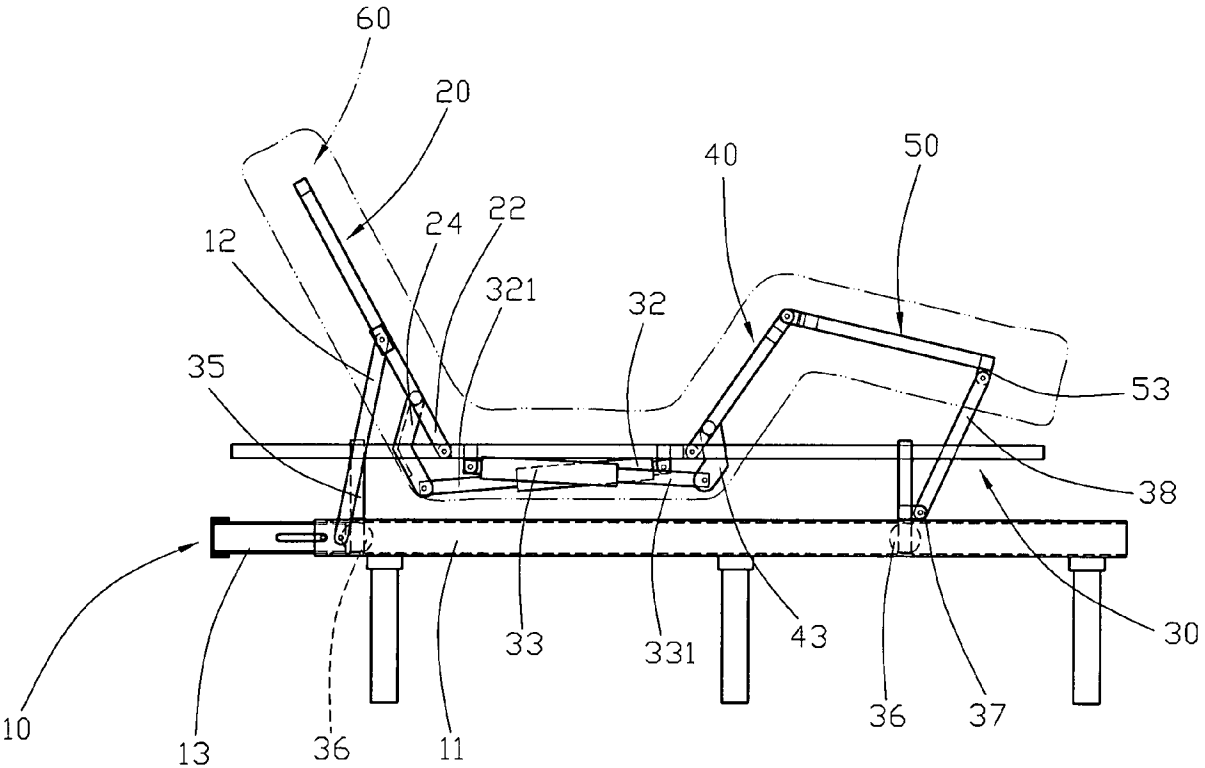
FIG. 7 is a schematic operational view of the motorized bed as shown in FIG. 4.

In operation, referring to FIGS. 5-7 with reference to FIGS. 1-4, when the retractable rod 321 of the drive cylinder 32 is expanded outwardly, the pivot arm 24 of the first support frame 20 is pushed upwardly by the retractable rod 321 of the drive cylinder 32, so that the first support frame 20 is pivoted upwardly relative to the linking frame 30, and the cushion 60 is moved upwardly with the first support frame 20. At the same time, each of the first links 12 is pivotally connected between the base frame 10 and the cushion 60, so that when the cushion 60 is moved upwardly with the first support frame 20, the cushion 60 is driven by the first links 12 to move forward toward the wall (or the extension brackets 13), and the linking frame 30 is driven by the cushion 60 to move forward on the base frame 10 toward the wall as shown in FIGS. 5-7. Thus, when the motorized bed is folded, the first (or front) portion of the cushion 60 is movable forward to get closer to the wall and a cabinet located beside the wall, so that a user can use the cabinet easily and conveniently, thereby facilitating the user taking items placed on the cabinet in an energy-saving manner.

In addition, when the retractable rod 331 of the drive cylinder 33 is expanded outwardly, the pivot arm 43 of the second support frame 40 is pushed upwardly by the retractable rod 321 of the drive cylinder 32, so that the second support frame 40 is pivoted upwardly relative to the linking frame 30 to lift the lift frame 50 which lifts the second links 38. At this time, the second (or rear) portion of the cushion 60 is lifted by the lift frame 50 and supported by the second support frame 40 and the second links 38 as shown in FIGS. 5-7, so that the user's legs are lifted and supported by the cushion 60 at a determined height, thereby providing a comfortable sensation to the user.

On the contrary, when the two drive cylinders 32 and 33 are folded, the first support frame 20, the second support frame 40 and the lift frame 50 are returned to the original position where the first support frame 20, the second support frame 40 and the lift frame 50 are in line with each other, so that the cushion 60 is expanded in a straight manner as shown in FIGS. 1-4.

Figure 8:
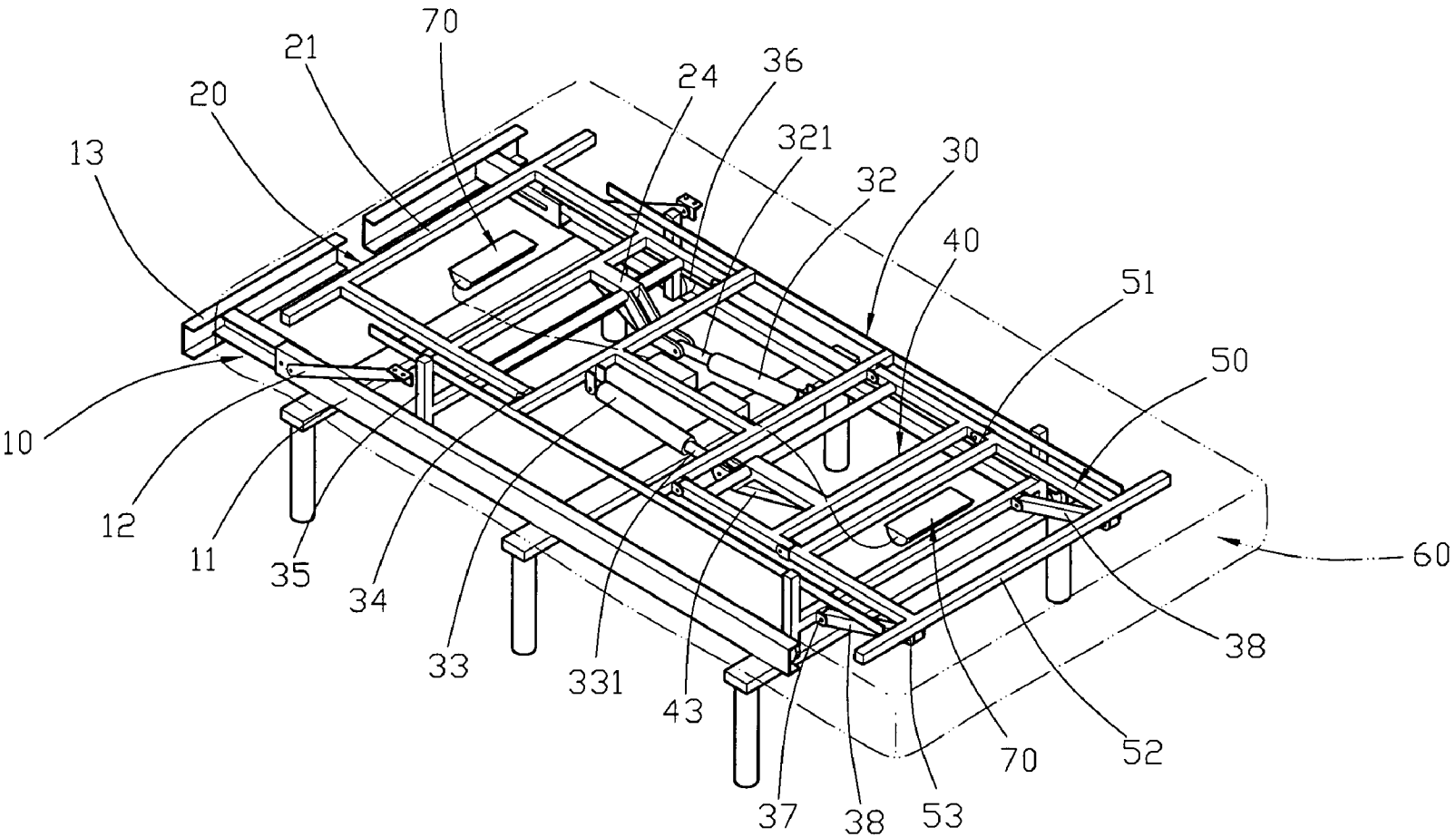
FIG. 8 is a perspective view of a motorized bed in accordance with another preferred embodiment of the present invention.

As shown in FIG. 8, the motorized bed further comprises a motor 70 mounted on the linking frame 30 and located under the cushion 60 to provide a vibration to the cushion 60, so that the motorized bed has a massaging function.

Accordingly, when the motorized bed is folded, the front portion of the cushion 60 is movably forward to get closer to the cabinet, so that a user can use the cabinet easily and conveniently, thereby facilitating the user taking items placed on the cabinet in an energy-saving manner. In addition, when the motorized bed is folded, the rear portion of the cushion 60 is lifted by the lift frame 50 and supported by the second support frame 40 an the second links 38, so that the user's legs are lifted and supported by the cushion 60 at a determined height, thereby providing a comfortable sensation to the user. Further, the motorized bed is operated automatically by the two drive cylinders 32 and 33, so that the user can operate the motorized bed easily and quickly in an energy-saving manner.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A motorized bed, comprising:

a base frame;

a linking frame movably mounted on the base frame;

a first support frame pivotally mounted on the linking frame;

two first links each pivotally mounted between the base frame and the first support frame;

a second support frame pivotally mounted on the linking frame;

a lift frame pivotally mounted on the second support frame;

two second links each pivotally mounted between the linking frame and the lift frame;

a cushion mounted on the linking frame and having a first portion mounted on the first support frame to move therewith and a second portion mounted on the second support frame and the lift frame to move therewith;

wherein the linking frame has a mediate portion provided with a support bracket;

the first support frame has a first portion pivotally mounted on the support bracket of the linking frame and a second portion provided with a resting bar rested on the cushion.

2. The motorized bed in accordance with claim 1, wherein the first support frame has a mediate portion provided with a transverse rod and a pivot arm having a first portion secured to the transverse rod, and the motorized bed further comprises a drive cylinder mounted between the linking frame and the first support frame and having a first portion pivotally mounted on the support bracket of the linking frame and a second portion provided with a retractable rod pivotally mounted on a second portion of the pivot arm of the first support frame.

3. The motorized bed in accordance with claim 2, wherein the pivot arm of the first support frame is substantially V-shaped.

4. The motorized bed in accordance with claim 2, wherein:

when the retractable rod of the drive cylinder is folded outwardly, the pivot arm of the first support frame is pushed upwardly by the retractable rod of the drive cylinder, so that the first support frame is pivoted upwardly relative to the linking frame, and the cushion is moved upwardly with the first support frame;

when the cushion is moved upwardly with the first support frame, the cushion is driven by the first links to move, and the linking frame is driven by the cushion to move on the base frame.

5. The motorized bed in accordance with claim 1, wherein the support bracket of the linking frame is provided with a plurality of pivot seats, and the first portion of the first support frame is pivotally mounted on the support bracket of the linking frame by the respective pivot seats of the linking frame.

6. The motorized bed in accordance with claim 1, further comprising a motor mounted on the linking frame and located under the cushion.

7. The motorized bed in accordance with claim 1, wherein the second support frame has a first portion pivotally mounted on the support bracket of the linking frame.

8. The motorized bed in accordance with claim 7, wherein the support bracket of the linking frame is provided with a plurality of pivot seats, and the first portion of the second support frame is pivotally mounted on the support bracket of the linking frame by the respective pivot seats of the linking frame.

9. The motorized bed in accordance with claim 7, wherein the second support frame has a second portion provided with a pivot arm, and the motorized bed further comprises a drive cylinder mounted between the linking frame and the second support frame and having a first portion pivotally mounted on the support bracket of the linking frame and a second portion provided with a retractable rod pivotally mounted on the pivot arm of the second support frame.

10. The motorized bed in accordance with claim 9, wherein when the retractable rod of the drive cylinder is folded outwardly, the pivot arm of the second support frame is pushed upwardly by the retractable rod of the drive cylinder, so that the second support frame is pivoted upwardly relative to the linking frame to lift the lift frame which lifts the second links.

11. The motorized bed in accordance with claim 9, wherein the pivot arm of the second support frame is substantially V-shaped.

12. The motorized bed in accordance with claim 9, wherein the lift frame has a first portion pivotally mounted on the second portion of the second support frame and a second portion provided with a resting bar rested on the cushion.

13. The motorized bed in accordance with claim 12, wherein each of the two second links has a first portion pivotally mounted on the linking frame and a second portion pivotally mounted on the resting bar of the lift frame.

14. A motorized bed, comprising:

a base frame;

a linking frame movably mounted on the base frame;

a first support frame pivotally mounted on the linking frame;

two first links each pivotally mounted between the base frame and the first support frame;

a second support frame pivotally mounted on the linking frame;

a lift frame pivotally mounted on the second support frame;

two second links each pivotally mounted between the linking frame and the lift frame;

a cushion mounted on the linking frame and having a first portion mounted on the first support frame to move therewith and a second portion mounted on the second support frame and the lift frame to move therewith;

wherein the linking frame has a first portion provided with a first slide movably mounted on the base frame and a second portion provided with a second slide movably mounted on the base frame.

15. The motorized bed in accordance with claim 14, wherein each of the first slide and the second slide of the linking frame is substantially H-shaped.

16. The motorized bed in accordance with claim 14, wherein the base frame is provided with two opposite guide tracks, and each of the first slide and the second slide of the linking frame is provided with two rollers rotatably mounted in the guide tracks of the base frame respectively so that the linking frame is movable between the guide tracks of the base frame.

17. The motorized bed in accordance with claim 16, wherein the base frame is provided with two extension brackets each adjustably mounted on the respective guide track.

18. A motorized bed, comprising:

a base frame;

a linking frame movably mounted on the base frame;

a first support frame pivotally mounted on the linking frame;

two first links each pivotally mounted between the base frame and the first support frame;

a second support frame pivotally mounted on the linking frame;

a lift frame pivotally mounted on the second support frame;

two second links each pivotally mounted between the linking frame and the lift frame;

a cushion mounted on the linking frame and having a first portion mounted on the first support frame to move therewith and a second portion mounted on the second support frame and the lift frame to move therewith;

wherein each of the two first links has a first portion pivotally mounted on the base frame and a second portion pivotally mounted on the first portion of the cushion.

* * * * *

US007448100C1

(12) INTER PARTES REEXAMINATION CERTIFICATE (687th)

United States Patent
Shih

(10) Number: US 7,448,100 C1
(45) Certificate Issued: Sep. 6, 2013

(54) MOTORIZED BED THAT IS MOVABLY CLOSER TO THE WALL

(75) Inventor: Lung-Tan Shih, Lukang Town (TW)

(73) Assignee: Ruoey Lung Enterprise Corp., Lukang Town, Changhua Hsien (TW)

Reexamination Request:
No. 95/000,652, Nov. 29, 2011

Reexamination Certificate for:

| | |
|---|---|
| Patent No.: | **7,448,100** |
| Issued: | **Nov. 11, 2008** |
| Appl. No.: | **11/472,208** |
| Filed: | **Jun. 21, 2006** |

(51) Int. Cl.
*A47B 71/00* (2006.01)

(52) U.S. Cl.
USPC ..... 5/600; 5/617; 5/619

(58) Field of Classification Search
None
See application file for complete search history.

(56) References Cited

To view the complete listing of prior art documents cited during the proceeding for Reexamination Control Number 95/000,652, please refer to the USPTO's public Patent Application Information Retrieval (PAIR) system under the Display References tab.

*Primary Examiner* — Peter C. English

(57) ABSTRACT

A motorized bed includes a base frame, a linking frame movably mounted on the base frame, a first support frame pivotally mounted on the linking frame, two first links each pivotally mounted between the base frame and the first support frame, a second support frame pivotally mounted on the linking frame, a lift frame pivotally mounted on the second support frame, two second links each pivotally mounted between the linking frame and the lift frame, and a cushion mounted on the linking frame. Thus, when the motorized bed is folded, the front portion of the cushion is movable forward to get closer to the cabinet, so that a user can use the cabinet easily and conveniently, thereby facilitating the user taking items placed on the cabinet.

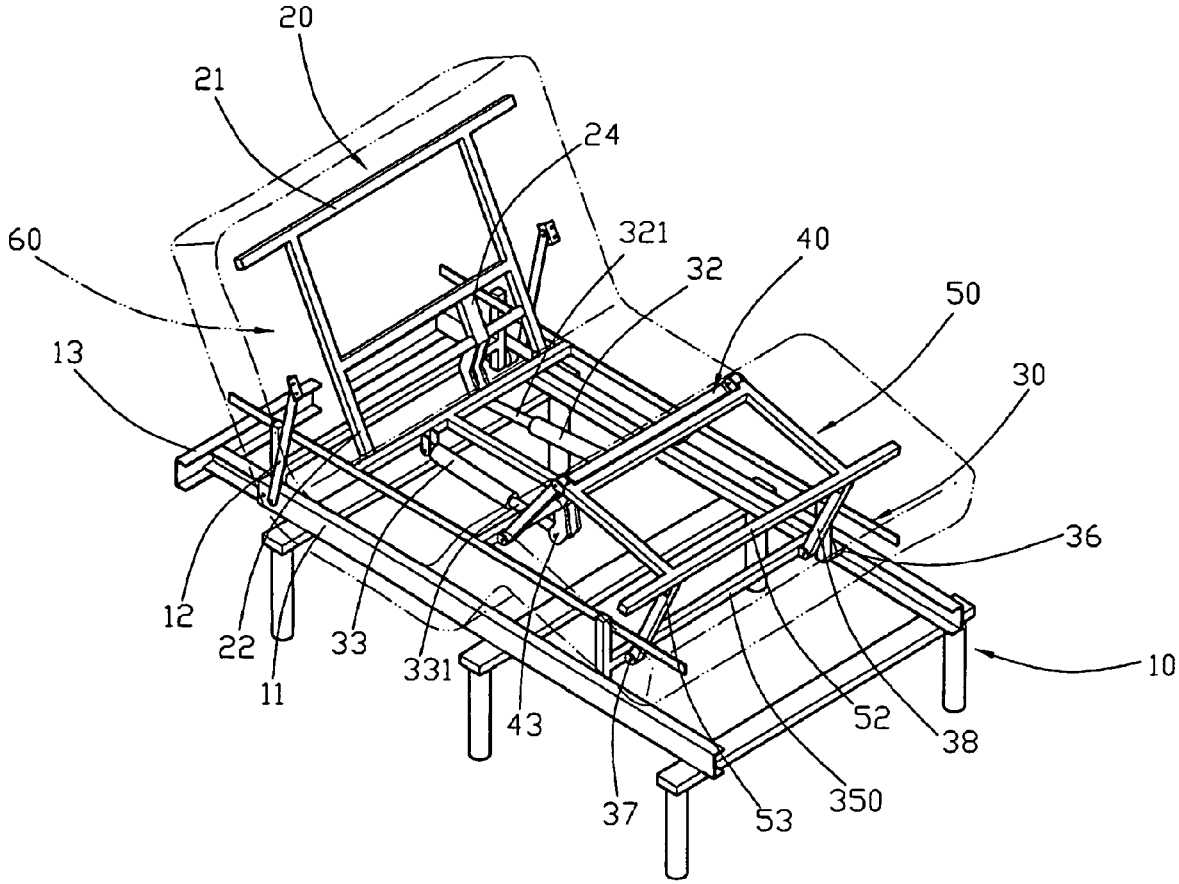

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1-18 are cancelled.

* * * * *